US006527571B2

(12) United States Patent
Muta et al.

(10) Patent No.: US 6,527,571 B2
(45) **Date of Patent: *Mar. 4, 2003**

(54) ELECTRICAL CONNECTING CONFIGURATION

(75) Inventors: Junji Muta, Yokkaichi (JP); Katsuya Ito, Yokkaichi (JP)

(73) Assignee: Sumitomo Wiring Systems, Ltd., Mie (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/448,902

(22) Filed: Nov. 29, 1999

(65) Prior Publication Data

US 2002/0111074 A1 Aug. 15, 2002

(30) Foreign Application Priority Data

Nov. 30, 1998 (JP) ..... 10-340160

(51) Int. Cl.[7] ..... H01R 13/64
(52) U.S. Cl. ..... 439/246; 439/76.2; 439/249
(58) Field of Search ..... 439/246, 883, 439/76.2, 95, 249, 247, 248

(56) References Cited

U.S. PATENT DOCUMENTS

| | | | | |
|---|---|---|---|---|
| 4,775,337 A | * | 10/1988 | Van Wagener et al. | 439/883 |
| 4,894,018 A | | 1/1990 | Phillips et al. | |
| 4,968,271 A | * | 11/1990 | Buscella | 439/860 |
| 5,018,990 A | * | 5/1991 | Sakamoto et al. | 439/620 |
| 5,707,243 A | | 1/1998 | Endo et al. | |
| 5,729,436 A | | 3/1998 | Yoshigi et al. | |
| 5,876,235 A | * | 3/1999 | Yoshigi | 439/384 |
| 5,941,716 A | * | 8/1999 | Yoshigi | 439/95 |
| 6,033,245 A | * | 3/2000 | Yamkovoy | 439/246 |

* cited by examiner

*Primary Examiner*—Renee Luebke
*Assistant Examiner*—Ross Gushi
(74) *Attorney, Agent, or Firm*—Banner & Witcoff, Ltd.

(57) ABSTRACT

Terminal fittings 30 are capable of moving in a direction perpendicular to a direction of joining of a coil unit 10 are located on a connector unit 20. Electric wires 40 have portions insulation 42 thereof removed, thus exposing conducting wires 41 which lie on a bent path. If terminal members 16 and terminal fittings 30 show a dislocation in position when the two units 10 and 20 are to be joined together, the exposed portion of the conducting wires 41 bends, and the terminal fittings 30 change position, thereby correcting the dislocation in position and allowing the terminal members 16 to fit without hindrance.

17 Claims, 6 Drawing Sheets

ELECTRICAL CONNECTING CONFIGURATION

TECHNICAL FIELD

The present invention relates to an electrical connecting configuration for a coil unit provided with a plurality of coils distributed in specific locations and a connector unit provided with connecting members distributed so as to correspond with the coils.

BACKGROUND TO THE INVENTION

A solenoid unit for controlling oil pressure is provided within a gearbox casing of an automatic transmission of an automobile. A connector unit attached to a wire harness outside the gearbox casing provides electricity to coils of this solenoid unit. An example of this connector unit is described in the laid open publication JP-9-55235. The solenoid unit thereof is provided with a coil unit having a plurality of coils distributed at specified locations on a base, these coils being fixed thereto, each of the coils being provided with a separate protruding terminal. The connector unit thereof has a plurality of plate-shaped terminal fittings distributed on the base so as to correspond to each of the coils. An attachment hole and a resilient clamping member protruding upwards from the hole edge of each attachment hole are formed on each plate-shaped terminal fitting. When a connector housing is attached to the coil unit, the protruding terminals pass through the attachment holes and are gripped by the resilient clamping members. The coil unit and the connector unit thereby attain an electrically connected state.

In the above example, the plurality of plate-shaped terminal fittings are positioned individually to correspond to the plurality of coils, and the two units are joined. In this configuration, even though the dimension error of each component and the attaching error of each unit are within the range of tolerance, this error accumulates when the two units are joined and consequently there is the danger of a larger dislocation appearing in position of the protruding terminals and the plate-shaped terminal fittings, thereby preventing the two units from fitting together smoothly.

The example disclosed in the above publication addresses this problem by providing resilient clamping members on the attachment holes into which the protruding terminals are fitted, these resilient clamping members being capable of bending resiliently. This resilient change of position is the means to absorb the dislocation in position. However, with this method, the maximum extent of dislocation absorption is limited to the greatest bending capacity of the resilient clamping members, and there are cases where the dislocation absorption is insufficient.

The present invention has been developed after taking the above problem into consideration, and aims to present an electrical connecting configuration in which the dislocation absorbing function of an electrical connecting member a coil unit and a connector unit is superior.

SUMMARY OF THE INVENTION

According to the invention there is provided an electrical coil unit comprising a base, a plurality of coils distributed on the base and each having a terminal, and a connector for the coils, the connector having a plurality of contacts, engageable one each with said terminals, and the contacts being connected to respective electrical wires having an insulating sheath thereon, characterised in that said terminals and contacts have a fitting direction, and said contacts are movable perpendicular to said fitting direction, and a portion of the insulated sheaths of said wires is removed along a bent portion thereof adjacent said contacts.

In such a device the contacts are able to move sideways to accommodate a build-up of tolerances, and the lack of insulation on a bent portion of the wire facilitates such movement since the wire is not still, and is in a pre-bent condition.

Preferably the terminals are upstanding pins of circular cross-section, and lying in a common plane perpendicular to the fitting direction.

The contacts are preferably resilient, and engage the respective pins on two sides thereof.

The cover is preferably an enclosure having chambers to permit movement of the contacts, and wire guiding channels to guide and permit bending of the uninsulated portions of said wires. In such an arrangement the cover has apertures to receive said pins. Preferably means within the chambers prevents movement of the contacts in the fitting direction.

BRIEF DESCRIPTION OF DRAWINGS

Other features of the invention will be apparent from the following description of a preferred embodiment shown by way of example. only in the accompanying drawings in which.

DESCRIPTION OF PREFERRED EMBODIMENT

Figure 1:
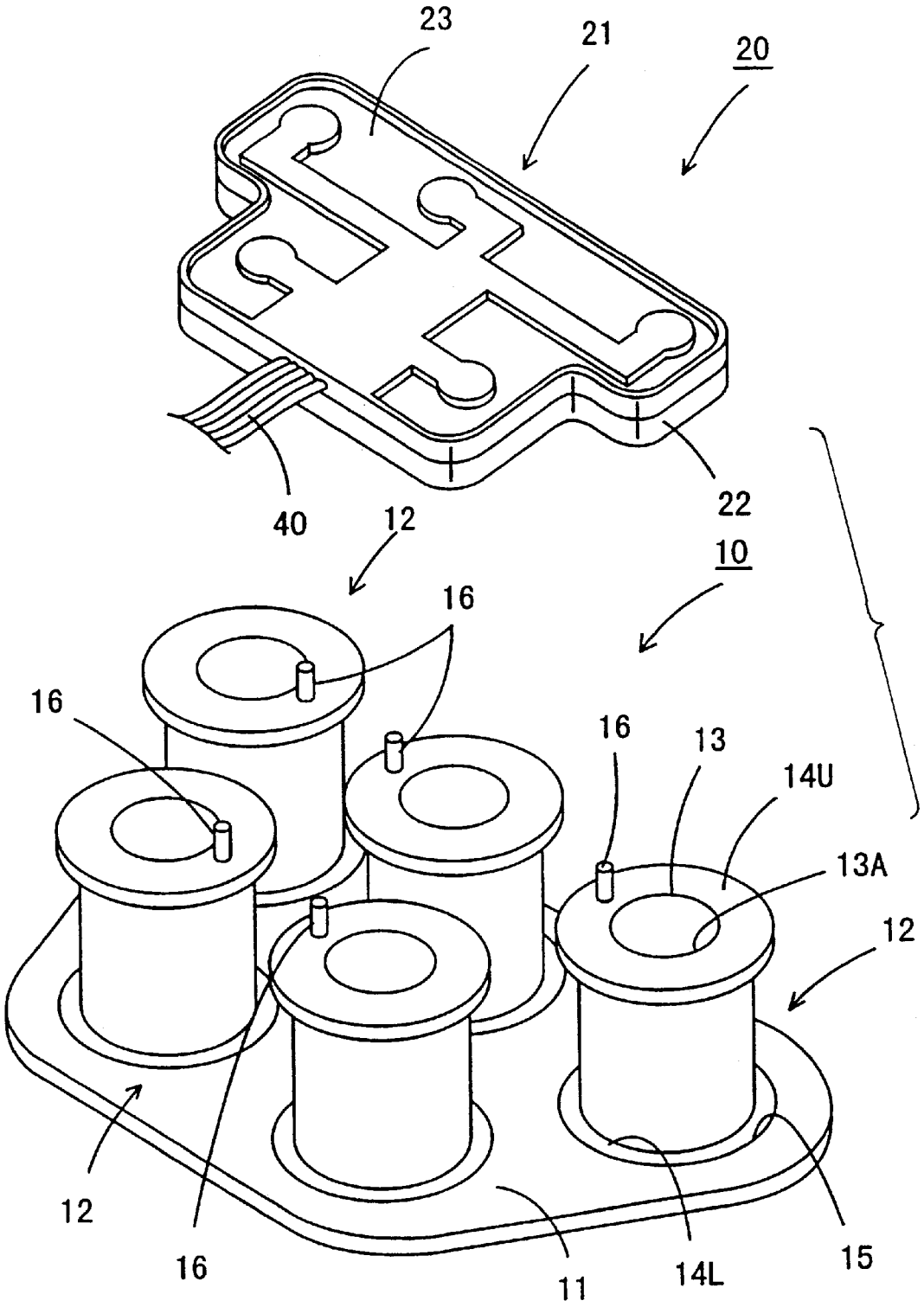
FIG. 1 is a diagonal view showing a coil unit and a connector unit of a first embodiment in a separated state.
Figure 2:
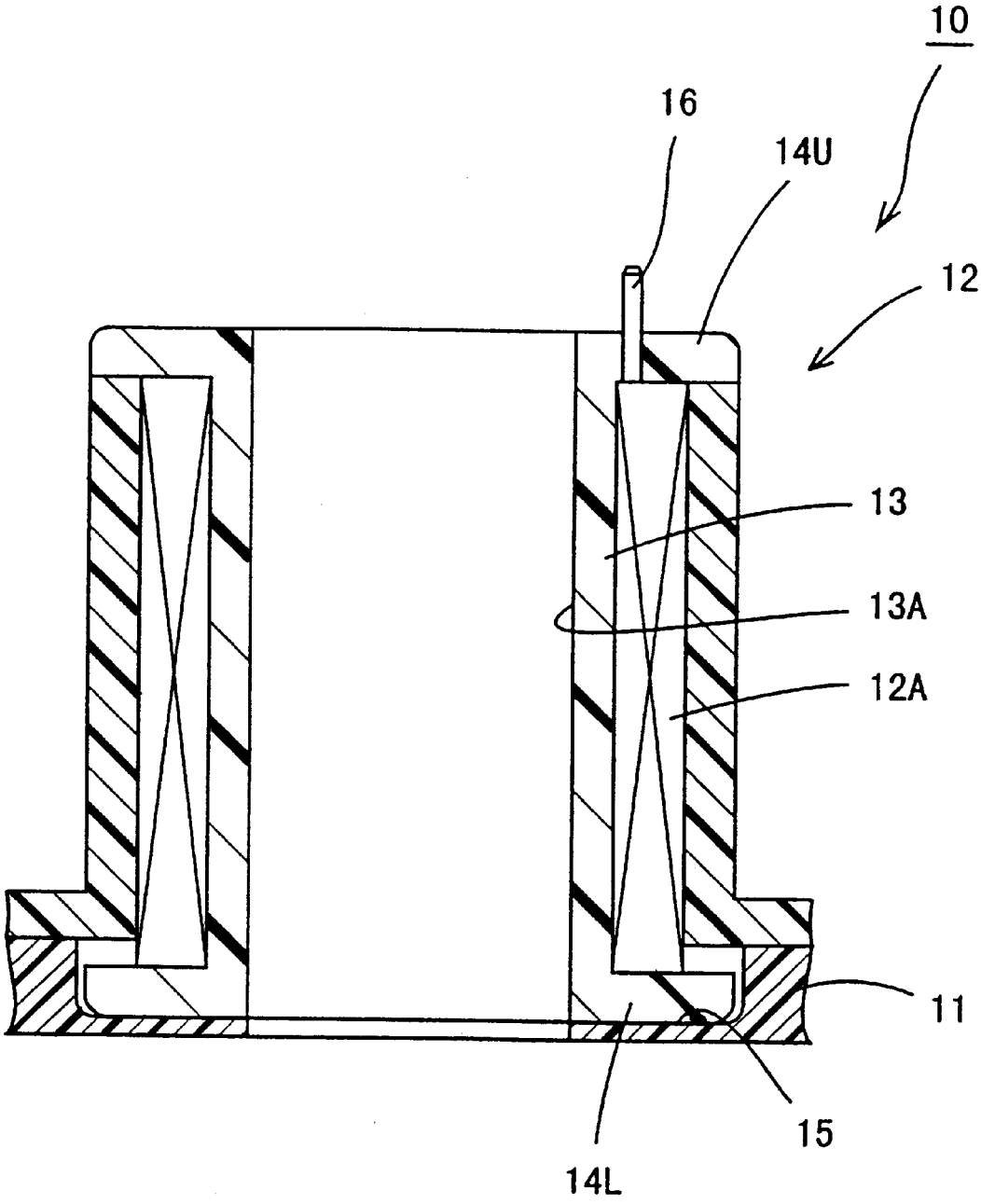
FIG. 2 is a partially expanded cross-sectional view of the coil unit.
Figure 3:
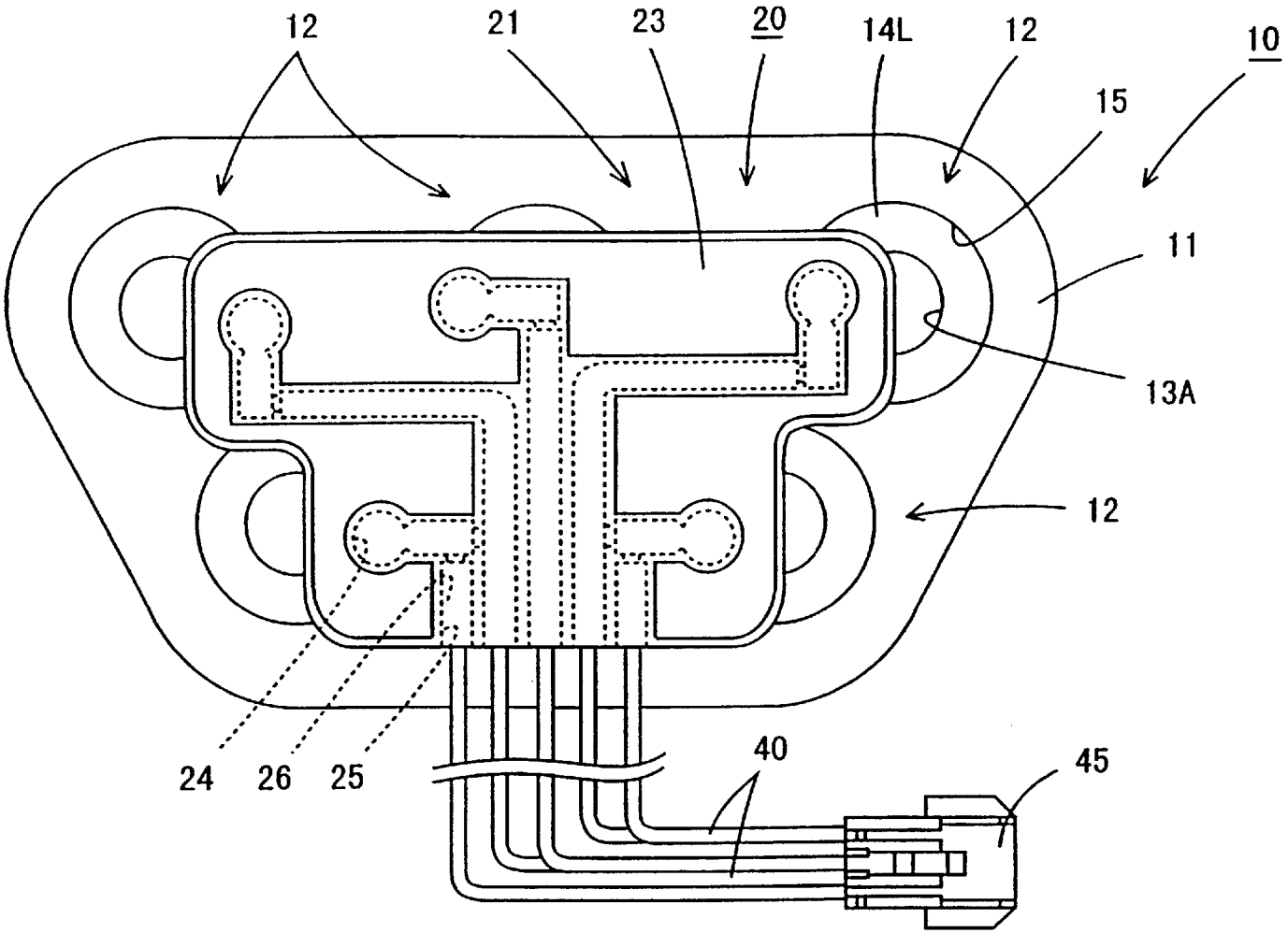
FIG. 3 is a plan view showing the two units in a joined state.
Figure 4:
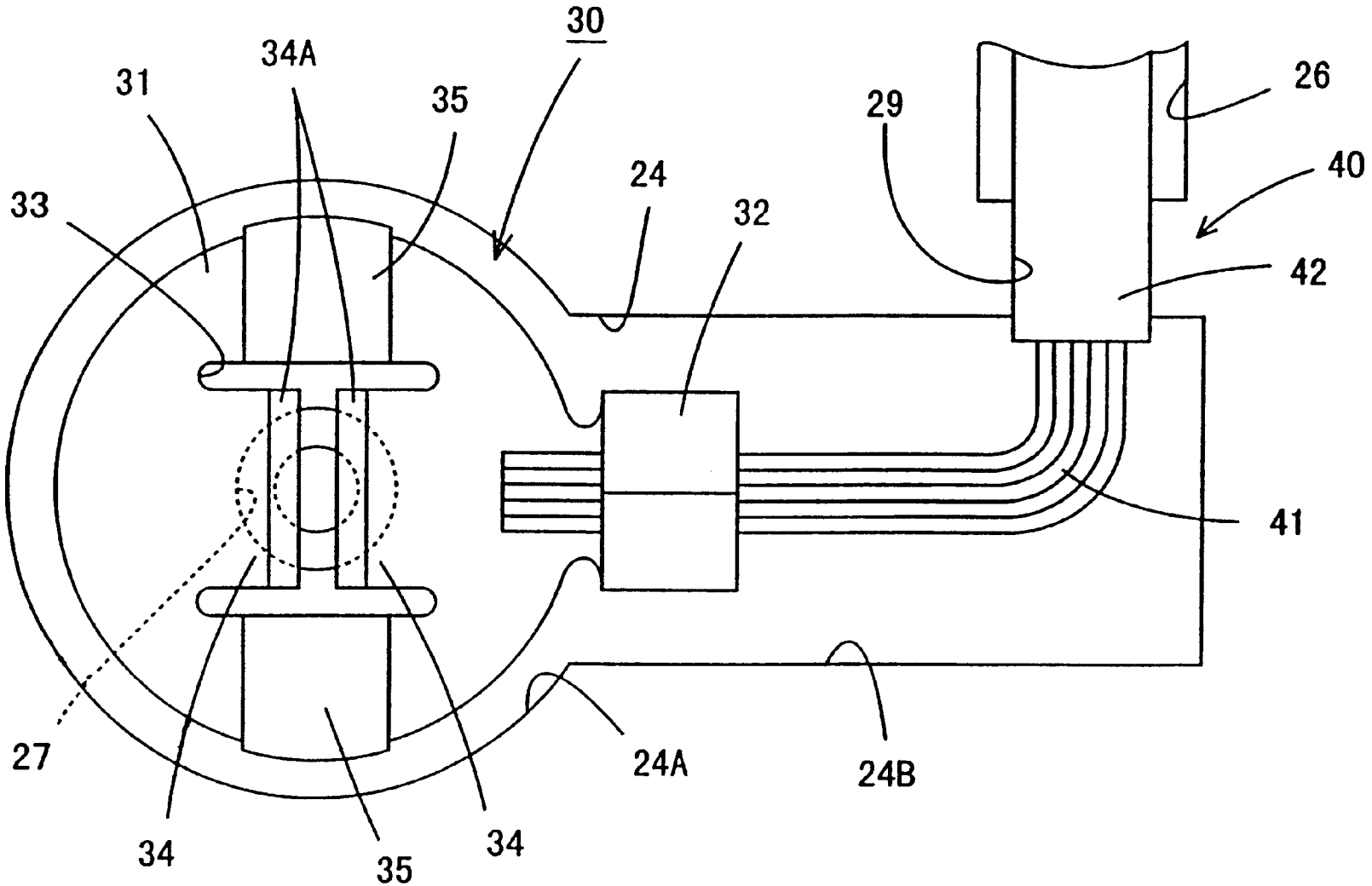
FIG. 4 is a plan view showing a terminal fitting and an electric wire in the connector unit in a joining state.
Figure 5:
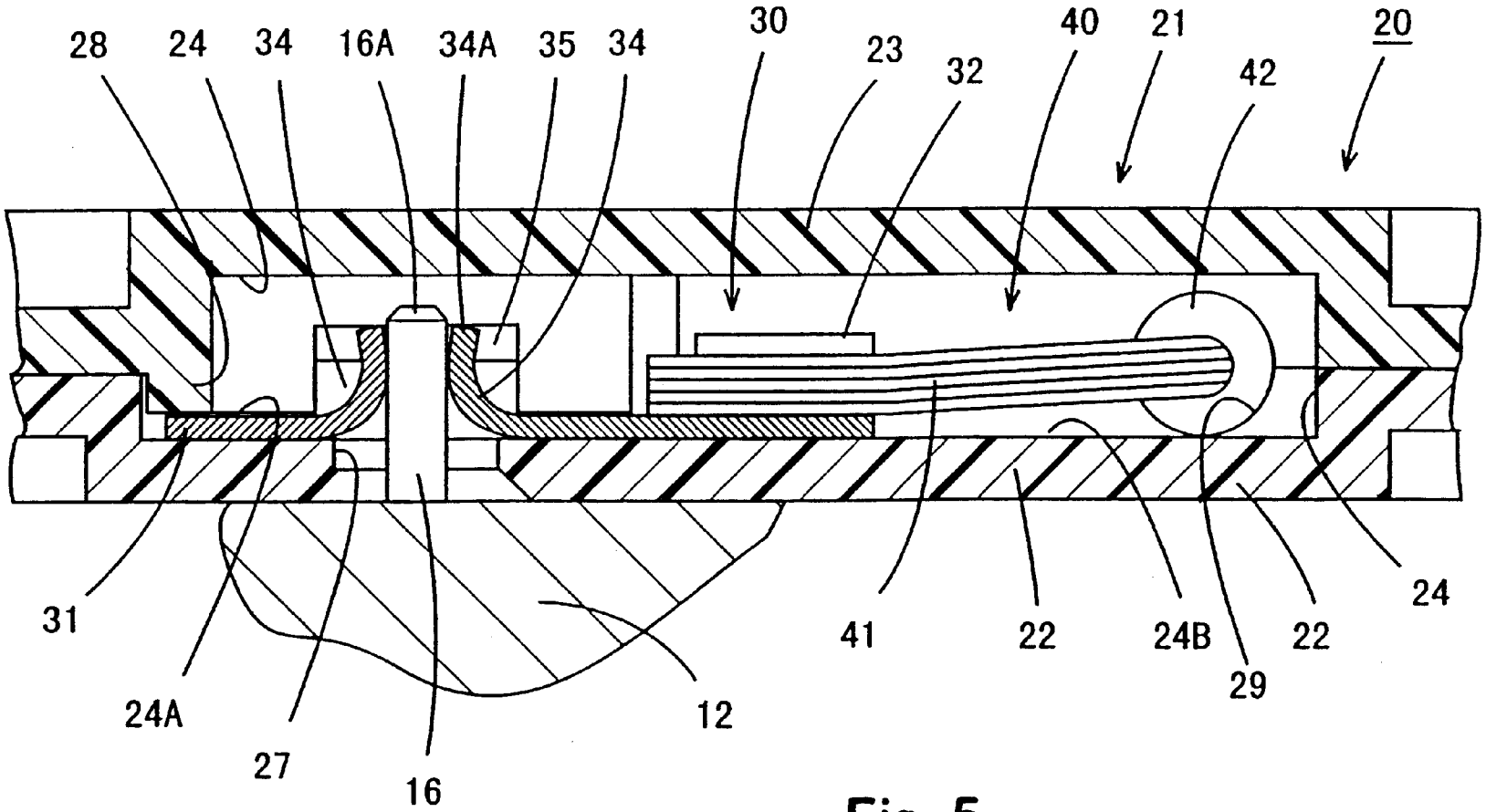
FIG. 5 is a partially expanded cross-sectional view showing the two units in an attached state.
Figure 6:
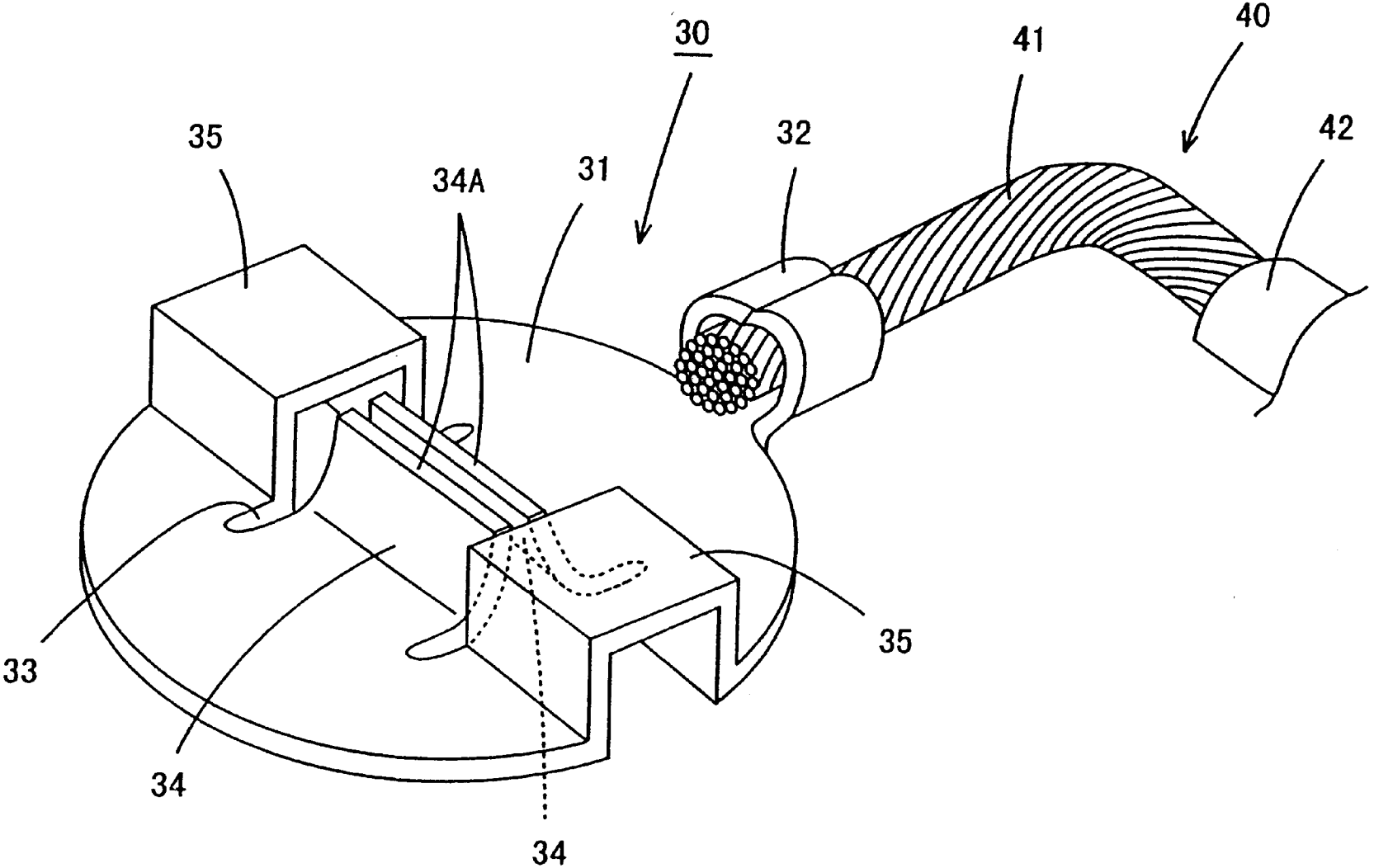
FIG. 6 is a diagonal view of the terminal fitting and the electric wire.

An embodiment of the present invention is explained below with the aid of FIGS. 1 to 6.

In the present embodiment, a solenoid unit for controlling oil pressure is provided within a gearbox casing of an automatic transmission of an automobile. This solenoid unit comprises a coil unit 10 and a connector 20 for providing electricity to the coil unit 10. When the connector 20 is joined to the coil unit 10 within the gearbox casing, the coil unit 10 and the connector 20 reach an electrically connected state. The connector 20 is connected to a wire harness via an interrupted connector which passes through the gearbox casing, this connector 20 providing electricity from a battery to each coil 12 of the coil unit 10.

The coil unit 10 comprises a trapezoidal plate-shaped base plate 11. A plurality of coils 12 (five in the present embodiment) are distributed in specified locations on an upper face thereof, and are fixed thereto. Each coil 12 comprises wires 12A wound around the outer circumference of a bobbin 13. A flange 14L at a lower end of the bobbin 13 fits into a coil attachment recess 15 of the base plate 11 and is fixed thereto by adhesive or other means, thereby unifying the bobbins 13 and the base plate 11. A flange 14U at an upper end of each bobbin 13 has a cross-sectionally circular terminal pin 16 fixed thereto in an upwardly protruding state, this terminal pin 16 being composed of electrically conductive material. An upper tip of each terminal pin 16 has a tapered face 16A. A lower end of each terminal pin 16 is fixed to an end of the element wires 12A located below the flange 14U. The flanges 14U at the upper sides of these five coils 12 have the same height, allowing the connector unit 20 to be positioned on these five flanges 14U.

Within this coil unit 10, a movable core (not shown) protrudes downwards within a central hole 13A of each bobbin 13, this movable core being attached so as to be movable in an axial direction. This forms the solenoid. When electricity is passed through the coils 12, this solenoid is magnetised and the movable core moves up and down, thereby controlling the oil pressure of the automatic transmission.

The connector 20 comprises a thick sheet-like housing 21 having five terminal fittings 30 therein, and electric wires 40 connected to each terminal fitting 30. The housing 21 has a sheet-like base 22 covered by a sheet-like cover 23, this cover 23 having the same shape and size as the base 22. A space is formed between the base 22 and the cover 23, this space housing the terminal fittings 30 and the electric wires 40. Five terminal fitting housing grooves 24 are formed on an upper face of the base 22, these corresponding to the terminal members 16 of the coil unit 10. In addition, electric wire housing grooves 26 are formed on the upper face of the base 22, these electric wire housing grooves 26 linking each terminal fitting housing groove 24 with electric wire outlet members 25 formed at the edge of an anterior side (the lower side in FIG. 3) of the base 22. A connecting portion of the electric wire housing grooves 26, connecting with the electric wire outlet members 25, is wide enough to allow the five electric wires 40 to be housed while they are aligned in a parallel manner. The electric wire housing grooves 26 branch out from this connecting portion towards the terminal fitting housing grooves 24. A lower face of the cover 23 also has terminal fitting housing grooves 24 and electric wire housing grooves 26, these corresponding with the terminal fitting housing grooves 24 and the electric wire housing grooves 26 of the base 22.

A circular through hole 27 passing from the top to the bottom of the base 22 is formed in each terminal fitting housing groove 24. These through holes 27 are distributed so as to be concentric with the terminal members 16 of the coil unit 10, the inner diameter of the through holes 27 being greater than the outer diameter of the terminal members 16. Moreover, the variation of tolerance between the outer diameter of the terminal members 16 and the inner diameter of the through holes 27 is identical with, or greater than, the maximum dimension of cumulative tolerance computed from the dimensional tolerance and attaching tolerance of the components of the coil unit 10 and the connector 20. Consequently, the terminal members 16 can be passed without difficulty through the through holes 27. The terminal fitting housing grooves 24, when seen from a plan view, are keyhole-shaped. That is, they consist of circular housing members 24A concentric with the through holes 17, and rectangular housing members 24B which are narrower than the diameter of the circular housing members 24A. The rectangular housing members 24B join with the electric wire housing grooves 26, and lower faces (the faces on which the terminal fittings 30 are positioned) of the housing members 24A and 24B are flush.

Each of the terminal fittings 30 comprises a circular sheet-like main body 31, and a barrel members 32 formed in a unified manner therewith and protruding from an outer edge of the main body 31. The terminal fittings 30 are positioned in the terminal fitting housing grooves 24, the main bodies 31 thereof being positioned within the circular housing members 24A and the barrel members 32 being positioned within the rectangular housing members 24B. The outer diameter of the main body 31 is smaller than the inner diameter of the circular housing members 24A. Consequently, the terminal fittings 30 within the terminal fitting housing grooves 24 are capable of sliding on the face on which they are positioned and are capable of moving freely two-dimensionally. The direction of movement of the terminal fittings 30 is a direction perpendicular to the direction of attachment of the two units 10 and 20 (the direction in which the terminal members 16 protrude). As above, the dimensions allowing movement of the terminal fittings 30 (this is equal to the variation of tolerance of the main bodies 31 and the circular housing members 24A) is identical with, or greater than, the maximum dimension of cumulative tolerance calculated from the tolerances of the two units 10 and 20. Consequently, even in the case whereby the cumulative tolerance is at its maximum, the terminal members 16 and the terminal fittings 30 can fit together.

The width of the barrel members 32, with the electric wires 40 in a crimped state, is smaller than the inner width of the rectangular housing members 24B, the variation of tolerance of the barrel members 32 being greater than the dimensions allowing maximum movement of the terminal fittings 30. Consequently, regulation of the movement of the terminal fittings 30 due to interference between the barrel members 32 and inner walls of the housing members 24B can be avoided. Furthermore, pressing members 28 are formed on the cover 23, each pressing member 28 being capable of sliding along a portion of the cover 23 corresponding to an upper face of a circumference edge of the main body 31. These pressing members 28 allow the terminal fittings 30 to move in a two dimensional direction (the direction perpendicular to the direction of joining of the two units 10 and 20), but regulate the upwards movement (the direction of joining of the two units 10 and 20) of the terminal fittings 30.

Each main body 31 of each terminal fitting 30 is formed by bending an oval-shaped sheet, an H-shaped slit 33 being formed in the centre thereof. By means of these slits 33 a pair of cantilever-like sheet members are bent into an arc and are made to protrude upwards, forming resilient contacts 34. The two end portions of the slit 33 are bent to become substantially square rising members 35. As a result of this bending operation, two mutually parallel rising edges 34A of the two resilient contacts 34 approach one another, the space between the two being smaller than the dimensions of the outer circumference of the terminal members 16. Further, the rising members 35 are in positions approaching the two ends of the rising edges 34A of the resilient contacts 34, the space between the two rising members 35 being greater than the dimensions of the outer circumference of the through holes 27. Since the rising members 35 are formed by making the resilient contacts 34 approach one another, the main body 31 assumes a circular shape when seen in plan.

The electric wires 40 crimped in the barrels 32 of the terminal fittings 30 are conventional, being composed of a conductor 41 made from thin metal wires twisted together and protected by a plastic cover 42. A specified length of the plastic cover 42 is removed at an end portion of these electric wires 40, the conductor 41 thus being in an exposed state. The exposed conductor is crimped within the barrels 32 of the terminal fittings 30. These crimped conductors 41 extend in a length-wise direction within the housing members 24B of the terminal fitting housing grooves 24, the ends thereof where the plastic cover 42 has been removed being bent at right angles at the corners of the housing members 24B. Since the portions of the conducting wires 41 exposed by the removal of the plastic cover 42 are not rigidified by the cover 42, the shape can be changed comparatively easily. The straight portions thereof can also bend comparatively easily.

The rectangular housing members 24B are linked at right angles, from the tips thereof, with the electric wire housing grooves 26 via narrow electric wire maintaining grooves 29. The plastic cover 42 of the electric wires 40 is fitted within these grooves 29 in a state whereby movement is regulated. The portions of the electric wires 40 covered by the plastic cover 42 pass through the electric wire housing grooves 26, extend to the exterior of the housing 21 from the electric wire outlet members 25, and connect with an outer connector 45. Next, the operation of the present embodiment will be explained.

When the connector unit 20 is to be joined to the coil unit 10, the housing 21 is positioned on the flanges 14U of the coils 12, the terminal members 16 are fixed in position on the housing 21 so as to correspond concentrically with the through holes 27 by a position fixing mean (not shown) such as concave-convex surfaces, and the two units 10 and 20 are fixed by a means such as adhesive. At this juncture, the housing 21 is resting on the flanges 14U, and the five terminal members 16 pass through the respective through holes 27 and push through the space between the resilient contacts 34. By this means the resilient contacts 34 grip both sides of the outer circumference face of the terminal members 16, the two making contact with a specified contact pressure. At this juncture, both resilient contacts 34 have a mutually identical degree of resilient bending.

When the two units 10 and 20 are to be joined together, there is the danger, due to the effects of tolerance, of a dislocation in position of the through holes 27 of the housing 21 relative to the terminal members 16, or of a dislocation in position of the terminal fittings 30 within the circular housing members 24A of the terminal fitting housing grooves 24. As a result, there is the danger that the terminal members 16 and the terminal fittings 30 will be fitted together with a large dislocation in core alignment (dislocation in position) of the main bodies 31 of the terminal fittings 30 relative to the terminal members 16.

In the case where the dislocation in core alignment of the main bodies 31 relative to the terminal members 16 is in an up-down direction (relative to FIG. 4), the terminal members 16 are pushed through almost the exact centre of the two resilient contacts 34. As a result, the terminal fittings 30 are fitted, in this position, with the terminal members 16. Although the terminal members 16 are dislocated at this juncture in a sideways direction, they are gripped by the rising edges 34A of the resilient contacts 34. Since both resilient contacts 34 have a mutually identical degree of resilient bending, the specified contact pressure can be maintained.

In the case where the dislocation in core alignment relative to the terminal members 16 is in a left-right direction (relative to FIG. 4), the terminal members 16 enter between the two resilient contacts 34 in a state whereby the terminal members 16 are further towards one of these resilient contacts 34. At this juncture, the tips of the terminal members 16 make contact with bent faces of the resilient contacts 34, the terminal fittings 30 thereby being caused to move in a left-right direction relative to FIG. 4, the terminal members 16 thereby attaining a position in the centre of the two resilient contacts 34. In this manner, the dislocation in core alignment is corrected, and the two resilient contacts 34 grip the terminal member 16 with the same degree of contact pressure.

In the case where the dislocation in core alignment is in a diagonal direction (relative to FIG. 4), the terminal fittings 30 change position in a left-right direction, thereby correcting the dislocation in core alignment in that direction, the terminal member 16 being gripped between the two resilient contacts 34 at a position above or below the centre.

In the embodiment described above, the terminal fittings 30 are capable of moving in a direction perpendicular to the direction of joining of the two units 10 and 20. As a result, even if there is a dislocation in position between the terminal members 16 and the terminal fittings 30 when the two units 10 and 20 are joined together, the terminal fittings 30 change position, thereby correcting this dislocation in position and allowing them to fit correctly with the terminal members 16. Consequently, the terminal fittings 30 and the terminal members 16 can fit together without hindrance. Furthermore, the absorption of the dislocation in position is not obtained by causing a certain portion of a certain component to change shape resiliently. Rather, this is obtained by the free movement of the independent terminal fittings 30. Consequently the range of movement, that is, the tolerance for absorbing the dislocation in position, can be specified at one's direction. As a result, even in the case whereby the cumulative tolerance arising from the components and the fitting together of the two units 10 and 20 is great, correspondence can still be attained.

When the terminal fittings 30 change position, the electric wires 40 change shape therewith. However, this change of shape of the electric wires 40 occurs at portions thereof which have been exposed due to the removal of the plastic cover 42 from the conducting wires 41. Consequently, flexural rigidity of the electric wires 40 is low, and they follow the movement of the terminal fittings 30 with ease. As a result, the function of changing the position of the terminal fittings 30, and thereby of correcting dislocation in position, can be performed smoothly.

Additionally, it is possible that, when the terminal fittings 30 move to correct the dislocation in position with the terminal members 16, they move diagonally instead of retaining a fixed orientation and moving in a parallel direction. If the terminal members have a plate-shape, there is the danger that, when the terminal fittings 30 become diagonally aligned, the bending force of the resilient contacts 34 increases and their contact force becomes too great. However, in the present embodiment, the terminal members 16 are cross-sectionally circular and have an upwardly protruding shape. Consequently, the terminal fittings 30 change their orientation while keeping the terminal members 16 as their centre and the resilient contacts 34 of the terminal fittings 30 retain their specified bending force. Consequently, changes in the contact force of the terminal members 16 and the terminal fittings 30 can be avoided.

The present invention is not limited to the embodiment described above with the aid of figures. For example, the possibilities described below also lie within the technical range of the present invention. In addition, the present invention may be embodied in various other ways without deviating from the scope thereof.

(1) In the present embodiment, the plastic cover of the electric wire is removed and an area of the conducting wires is exposed, this area joining with a crimped portion which joins with the terminal fittings. However, according to the present invention, the portion which is crimped by the terminal fittings may remain covered by the plastic cover, a portion of the plastic cover instead being removed along the wire distribution path to expose the conducting.wires.

(2) In the present embodiment, the area of the electric wire which has been exposed by the removal of the plastic cover is distributed in an L-shape. However, according to the present invention, this may equally well be any other bent path, such as an S-shape, a Z-shape, a wave-shape etc.

(3) In the present embodiment, the connecting form of the coil unit has a protruding shape and the connecting form of the connector unit is in the form of a hole. However, according to the present invention, the coil unit may equally well have a hole and the connector unit may have a protrusion.

(4) In the present embodiment, the terminal members of the coil unit have a round pin-shape. However, according to the present invention, the terminal members may equally well have a square pin-shape, a plate-shape, etc.

(5) In the present embodiment, the resilient contacts are provided as a pair. However, according to the present invention, a single resilient contact may be provided, this making contact with the terminal member by pressing against it from the side.

What is claimed is:

1. An electrical coil unit comprising a base, a plurality of coils distributed on the base, each coil having a terminal having a width, and a connector for the coils, the connector having a plurality of contacts engageable one each with said terminals, each of the contacts being connected to a respective electrical wire, wherein said terminals and contacts have a fitting direction, each said contact has an opening to receive the respective terminal that is substantially wider in a first direction perpendicular to the fitting direction than the width of the corresponding terminal, and said contacts are movable relative to the respective terminals during fitting with the respective terminals in a second direction perpendicular to said fitting direction, whereby the contacts accommodate dislocation of the respective terminals in two perpendicular directions to the fitting direction, each of the contacts including a resilient contact member on each of opposite sides of the opening and each resilient contact member extending substantially the entire width of the opening in the first direction perpendicular to the fitting direction, and wherein each wire includes insulating sheathing with a portion of the sheathing being removed adjacent the end of the wire to define an unsheathed portion of wire having an unsecured substantial length that extends from the contact to permit the shape of the wire to be easily changed and the contact to be easily moved, wherein each contact includes a sheet-like base, the resilient contact members defining the opening and extending from the sheet-like base, and wherein the connector further includes a plurality of pressing members, each pressing member contacting a corresponding sheet-like base to preclude movement of the corresponding contact in the fitting direction.

2. A unit according to claim 1 wherein said connector includes a chamber for each of said contacts, and a floating control member in each chamber to permit floating movement of said contacts perpendicular to said fitting direction.

3. A unit according to claim 1 wherein a cover encloses said contacts and includes a plurality of apertures to permit engagement of said terminals and contacts.

4. A unit according to claim 1 wherein tips of said terminals are co-planar.

5. A unit according to claim 1 wherein the wires include insulating sheathing and the sheathing is removed along a bent portion of the wire adjacent the contacts.

6. An electrical coil unit in accordance with claim 1 wherein each contact includes a barrel portion for connecting to the unsheathed wire, and the barrel portion has a certain length in the direction of the wire that is less than the unsecured substantial length of unsheathed wire.

7. An electrical coil unit in accordance with claim 6, wherein the unsecured substantial length of unsheathed wire has a bend of around ninety degrees.

8. A unit according to claim 1 wherein said terminals comprise upstanding pins.

9. A unit according to claim 8 wherein said pins are circular in cross-section.

10. A unit according to claim 8 wherein said contacts are resilicnt.

11. A unit according to claim 9 wherein said contacts are resilient.

12. A unit according to claim 11 wherein said contacts comprise a base having an aperture therethrough and upstanding resilient arms on either side of said aperture, the spacing between said arms being less than the thickness of said pins.

13. A unit according to claim 12 wherein said arms project in the same direction as said pins on mutual engagement thereof.

14. A unit according to claim 10 wherein said contacts comprise a base having an aperture therethrough and upstanding resilient arms on either side of said aperture, the spacing between said arms being less than the thickness of said pins.

15. A unit according to claim 14 wherein said base is substantially circular.

16. A unit according to claim 14 wherein said arms project in the same direction as said pins on mutual engagement thereof.

17. A unit according to claim 16 wherein said base is substantially circular.

* * * * *